United States Patent [19]

Allen

[11] Patent Number: 4,539,784

[45] Date of Patent: Sep. 10, 1985

[54] ADJUSTABLE DOOR JAMB ANCHOR

[76] Inventor: Ernest R. Allen, 1131 Vine St., Jonesboro, Ark. 72401

[21] Appl. No.: 580,348

[22] Filed: Feb. 15, 1984

Related U.S. Application Data

[63] Continuation-in-part of Ser. No. 547,137, Oct. 31, 1983, , which is a continuation-in-part of Ser. No. 418,429, Sep. 15, 1982, Pat. No. 4,478,016.

[51] Int. Cl.[3] ..... E06B 1/04

[52] U.S. Cl. ..... 52/217; 52/741; 52/126.1

[58] Field of Search ..... 52/126.1, 126.4, 741, 52/217, 713, 213

[56] References Cited

U.S. PATENT DOCUMENTS

| | | | |
|---|---|---|---|
| 2,574,350 | 11/1951 | Peelle | 52/213 |
| 3,363,392 | 1/1968 | Boughner | 52/217 X |
| 3,445,977 | 5/1969 | Latiano | 52/217 X |
| 3,636,672 | 1/1972 | Fink | 52/217 X |
| 3,793,788 | 2/1974 | Collins | 52/217 X |
| 4,478,016 | 10/1984 | Allen | 52/213 X |

*Primary Examiner*—Carl D. Friedman

*Attorney, Agent, or Firm*—LeBlanc, Nolan, Shur & Nies

[57] ABSTRACT

An adjustable device for anchoring door jambs of various sizes in a fast and efficient manner. The device includes one or more frame members which receive a pair of overlapping L-shaped planar members in sliding engagement with each other. Each frame member is generally of an L-shaped configuration having vertical and horizontal planar portions, and with a lip formed along the outer edge of the horizontal portion to provide a slot for use in retaining the overlapping members. The overlapping members each have vertical and horizontal planar portions, with the horizontal portions being of sufficient length to allow the length of the overall anchor to be varied by slidably positioning the overlapping members relative to each other. The position of each frame member relative to the overlapping members can also be adjusted to correspond with the shape and construction of a particular door jamb.

11 Claims, 6 Drawing Figures

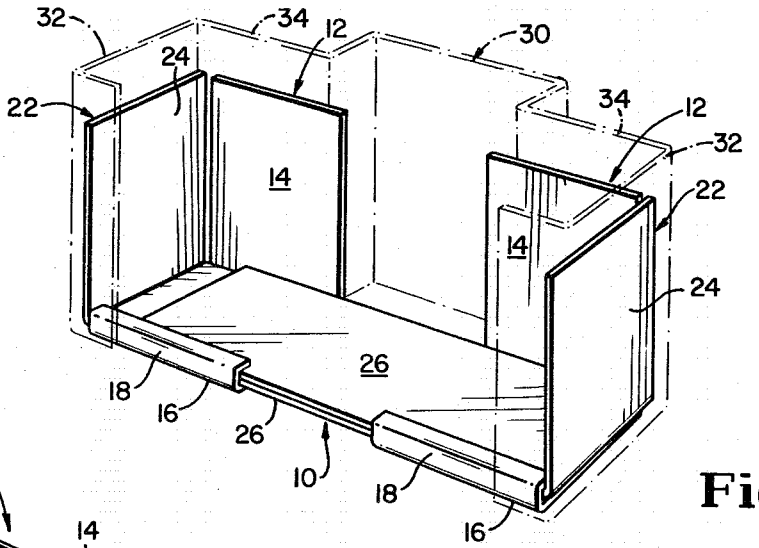
Fig. 1
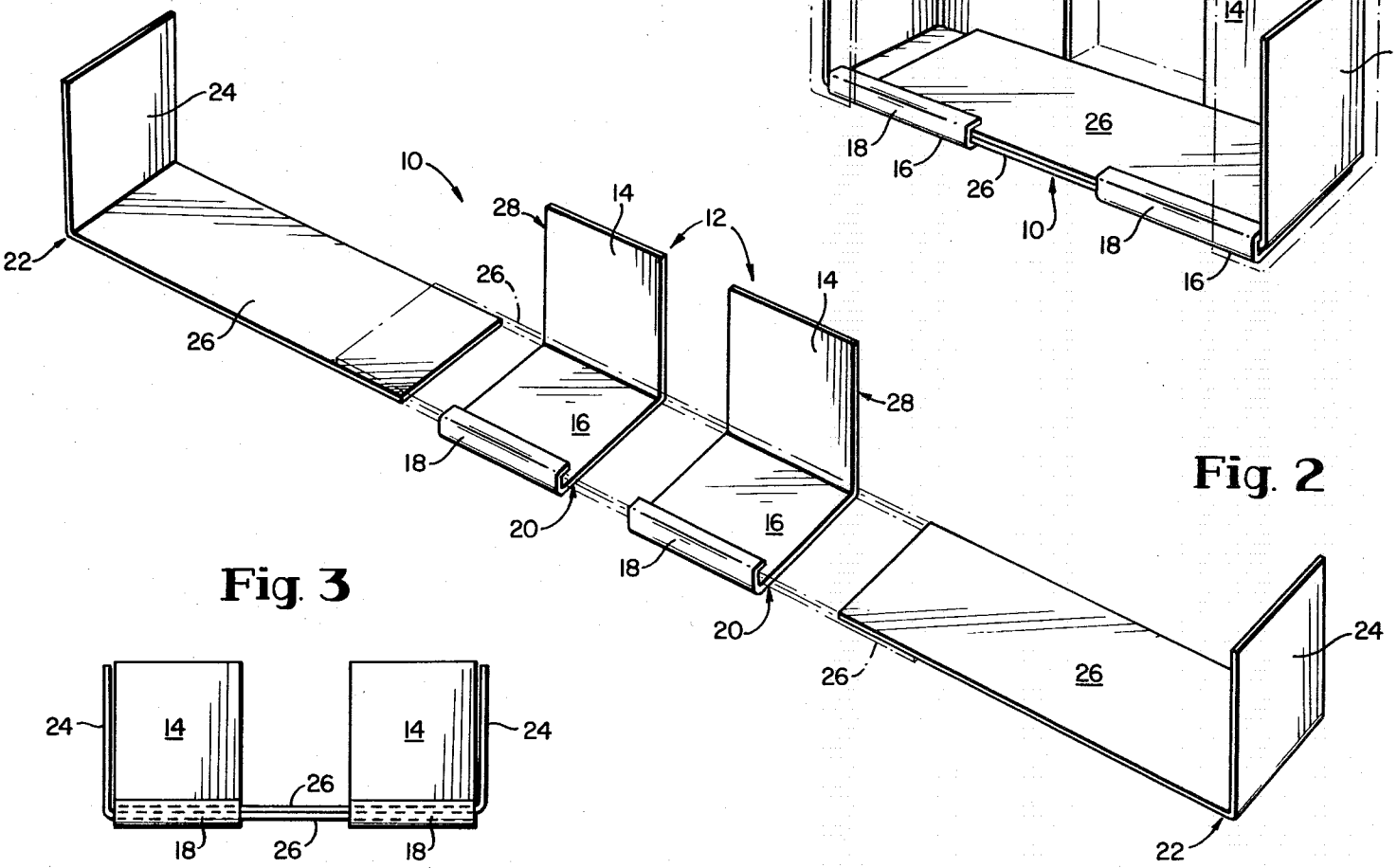
Fig. 2
Fig. 3

40
41
42
44
46
47
48
50
54
56
58
59
60
61
62
63
64
65
66
68
70
72

ADJUSTABLE DOOR JAMB ANCHOR

BACKGROUND AND SUMMARY OF THE INVENTION

This is a continuation-in-part of application Ser. No. 547,137 filed Oct. 31, 1983 which is a continuation-in-part of application Ser. No. 418,429 filed Sept. 15, 1982 now U.S. Pat. No. 4,478,016.

The present invention relates to a device for anchoring door jambs. More particularly, the present invention is concerned with an adjustable device which allows the anchoring of prefabricated metal door jambs of various sizes and which may be employed in levelling door jambs without the use of wedges so that the door jambs may be very rapidly erected and secured to the floor during construction of a building in which doors or similar frames are to be installed.

Previous jamb anchors for use in anchoring a doorframe in place include the jamb anchor described in U.S. Pat. No. 3,636,672 to Fink.

By the present invention there is provided an adjustable device for use in anchoring door jambs of various sizes in a rapid and efficient manner. The adjustable jamb anchor of the present invention includes one or more frame members which receive a pair of overlapping L-shaped planar members in sliding engagement. Each frame member is generally of an L-shaped configuration having vertical and horizontal planar portions, and with a lip portion along the outer edge of the horizontal portion for use in retaining the overlapping L-shaped members. The overlapping L-shaped members each have vertical and horizontal planar portions, with the horizontal portions being of sufficient length to allow the length of the overall anchor to be varied by slidably positioning the overlapping members relative to each other. In this manner, the length of the anchor can be adjusted to fit door jambs of various sizes. The position of each frame member relative to the overlapping members can also be adjusted to correspond with the shape and construction of a particular door jamb.

Accordingly, it is an object of the present invention to provide an anchoring device which may be adjusted to fit door jambs of various sizes.

It is another object of the present invention to provide an adjustable door jamb anchor which may be easily employed in the installation and leveling of door jambs.

It is a further object of the invention to provide a jamb anchor of compact construction which is readily adjustable for use on the job in anchoring door jambs.

It is another object of the invention to provide an adjustable jamb anchor which may be easily manufactured in large quantities for use in the construction industry.

The foregoing and additional objects are obtained by the adjustable jamb anchor of the present invention having the specific characteristics and features as described herein.

BRIEF DESCRIPTION OF THE DRAWINGS

FIG. 1 is a perspective view of the adjustable jamb anchor of the present invention showing the anchor within a door jamb in position for anchoring the door jamb to the floor or other surface.

FIG. 2 is a perspective view in exploded form showing the various components of the adjustable jamb anchor of FIG. 1.

FIG. 3 is a front elevation of the adjustable jamb anchor of FIG. 1.

DESCRIPTION OF THE PREFERRED EMBODIMENTS

Figures 4, 5, 6:
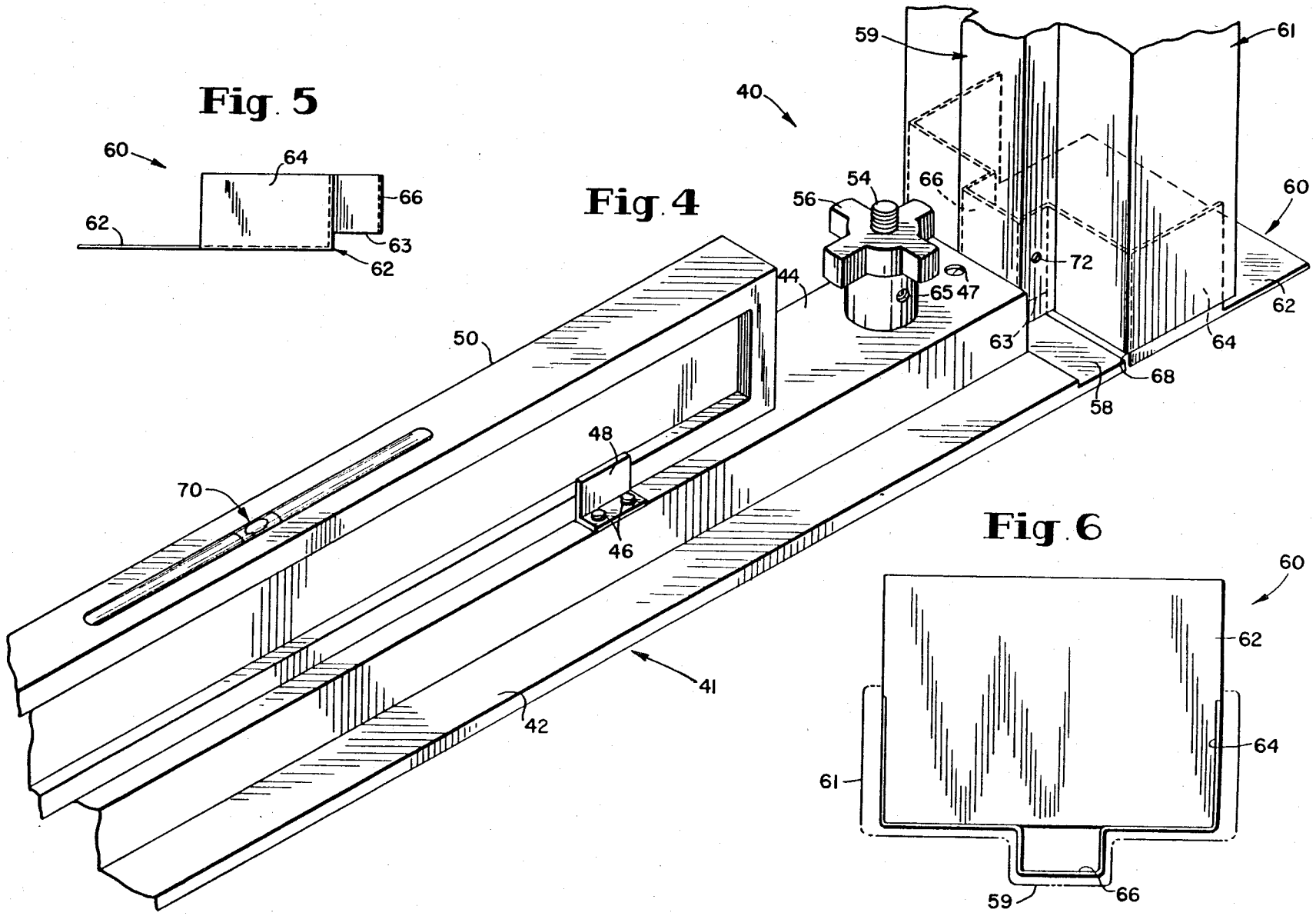
FIG. 4 is a perspective view showing a leveling assembly which may be utilized in leveling a door jamb, in conjunction with a jamb anchor.
FIG. 5 is a side elevation of a jamb anchor which may be employed with the leveling assembly of FIG. 4.
FIG. 6 is a plan view of a jamb anchor which may be employed with the leveling assembly of FIG. 4.

In the embodiment of the adjustable jamb anchor 10 of the present invention, as shown in FIGS. 1 through 3, there are provided a pair of support frame members 12 each of which is of an L-shaped configuration formed with vertical planar portion 14 and horizontal planar portion 16. The terms "vertical" and "horizontal" are relative terms used for ease of description and it will be understood that the anchor device 10 may be turned in any direction except when installed in the floor or other surface for the intended purpose of anchoring a door jamb.

At the outer edge of each horizontal portion 16, there is provided a lip portion 18 of a generally U-shaped cross section which curves back over horizontal portion 16 so as to form a slot 20 extending along the entire outer edge of each portion 16.

The anchor 10 further includes a pair of L-shaped members 22 each of which is formed with vertical planar portion 24 and horizontal planar portion 26.

The planar portions of all of the members 12 and 22 may be of a similar thickness if desired. In any event, the slot 20 in members 12 is of sufficient height so as to allow the members 22 to be received therein in overlapping, sliding engagement as shown in FIGS. 1 through 3.

The width of the support frame members 11 should be approximately equal to the width of the overlapping members 22 so that members 22 will be retained snugly beween the vertical portion 14 and the lip 18 of each frame member 12 while allowing smooth, longitudinal sliding movement of the members 22 in overlapping engagement with each other.

In the use of the adjustable jamb anchor 10 of the present invention, the two support frames 12 are arranged with respective portions 14, 16, 18 and slots 20 in parallel alignment as shown in FIG. 2 and the L-shaped members 22 are passed through the slots 20 in overlapping engagement with each other so as to be partially supported by the horizontal portions 16 of the support frames 12. The anchor 10 may then be positioned within a door jamb 30 as shown in FIG. 1 with the overlapping members 22 being positioned so that vertical portions 24 are contiguous with the end walls 32 of the door jamb 30. The frame members 12 may be positioned as shown in FIG. 1 with the outer side edge 28 of each frame 12 positioned adjacent the respective vertical portions 24 of the overlapping members 22. Thus the vertical portions 14 of the frames 12 will be contiguous with the side wall 34 of the door jamb 30. The distance between frames 12 may be adjusted for particular uses, however, and the position of the frames 12 relative to each other may be varied for particular applications and also depending on the configuration of the particular door jamb.

It will be seen from FIG. 1 that the frame members 12 and overlapping members 22 may be manufactured in any of various widths so as to fit within the dimensions of a particular door jamb configuration. The overlapping characteristic of member 22 however allows the present anchor 10 to be adjusted in the length dimension without the necessity for manufacturing anchors of different lengths for each door jamb having a different size or shape.

Once the dimensions of a particular door jamb have been determined, the jamb anchor 10 of the present invention may be adjusted to that size, after which the anchor 10 may then be bolted or otherwise secured to the floor in the desired position. The door jamb may then be positioned over the anchor 10 as shown in FIG. 1 and the jamb secured to the anchor 10 by the use of anchor screws, welding or other suitable means. In this regard, each member 12 and 22 of the anchor 10 may be secured both to the floor and to the door jamb, thus preventing any relative movement of the components 12, 22 after the door jamb has been installed. Relative movement between components may also be prevented by securing the overlapping members in a fixed position relative to each other, or by securing each overlapping member to a common frame member, by the use of screws or similar means.

In one particular application of the present invention, the adjustable jamb anchor 10 may be employed in the leveling of a door jamb. In FIGS. 4 through 6, there is shown a device 40 for use in leveling door jambs as described in U.S. patent application Ser. No. 418,429 filed Sept. 15, 1982.

In the door jamb leveler device 40 as shown in FIGS. 4 through 6, there is provided a spacer plate assembly 41 including planar member 42 which functions as a central spacer member in conjunction with an upper block member 44 mounted on member 42 and extending along the entire length of the main portion of member 42.

The block member 44 is mounted on the planar member 42 by suitable attachment means such as screws 46 which extend upwardly through holes in planar member 42 and block 44. Additional attachment means may extend through holes 47. The upper ends of screws 46 are threadedly received in L-shaped bracket members 48 which are mounted on the upper surface of the block member 44 for the purpose of receiving a standard carpenter's level 50.

The planar member 42 is provided with a threaded aperture at each end thereof for the purpose of receiving a bolt shaped, threaded swivel member 54 which extends upwardly through respective apertures in members 42 and 44. A hand screw 56 in the form of a knob shaped member of conventional construction is threadedly received on the upper end of each of the swivel members 54. A set screw or similar means is inserted in hole 65 in the side of each hand screw 56 to maintain the hand screw 56 in a fixed position on the respective swivel member 54. In one embodiment, the swivel member 54 is formed with a swivel construction directly below the threaded portion of member 54, thus allowing the threaded portion to pivot about the base of member 54. One form of such a swivel member is known as a knob shoe.

The planar member 42 is provided with a lip extension 58 of relatively thin vertical dimension on each end of member 42. The lip extensions 58 extend beneath the inner portions 59 of the sides of the jamb 61 during the leveling procedure.

The door jamb leveler device 40 of FIGS. 4 through 6 further includes a pair of anchor base plate members 60, with each anchor plate member 60 having a horizontal planar portion 62 and an upstanding vertical portion 64 in sheet form which extends upwardly from planar portion 62 and conforms to the configuration of the interior of the follow vertical side portion of the door jamb 61. The central portion 66 of each upstanding member 64, conforming to the inner portion 59 of the side wall of the door jamb 61, has its lower edge 63 sufficiently raised above the planar portion 62 so as to avoid being engaged by the lip extension 58 on member 42 during the leveling operation. The outer end of each lip extension 58 of the planar spacing member 42 is thus contiguous in use with the respective inner end 68 of the horizontal planar portion 62 of the base plate members 60, as shown in FIG. 4.

The adjustable jamb anchor 10 of the present invention may be substituted in the device 40 of FIG. 4 for the anchor 60 shown therein. It is pointed out that the configuration of the present anchor 10 will result in the anchor 10 not interfering in any way with the lip extensions 58 on member 42 during the leveling procedure.

In order to level the door jamb 61, the spacer plate assembly 41 is positioned on the floor so as to extend across the width of the proposed doorway. The base plates 60 are then positioned on the floor so as to be contiguous with the lip extensions 58 at each end of the spacer member 42 as previously described. The outer edge of each lip extension will be aligned along the length of the inner end portion 68 of the base plate 60, thus aiding in proper alignment of the base plate 60 and the door jamb 61. The base plates 60 are anchored to the floor by the use of, for example, a conventional anchoring gun with suitable rivets or similar means. The door jamb 61 is then poisitioned so that the side wall portions will coincide with previously formed vertical members 64 of the base plates 60 and with inner portions 59 of the jamb 61 resting on the lip extensions 58 of the spacer member 42. The hand screws 56 at each end of spacer plate assembly 41 are then manually turned, causing the spacer member 42 to move up or down along the length of the threaded swivel members 54. Turning of the hand screws 56 continues until the sight glass 70 in the carpenter's level 50 shows the jamb 61 to be in a level condition. Anchor screws 72 are then driven through the jamb 61 into the jamb anchor base plates 60 at either end to retain the jamb 61 at the desired height. The spacer plate assembly 41 may then be removed from the doorway by sliding the lip extensions 58 out from under jamb inner portions 59 and the jamb 61 will be retained in a level position by the anchor plates 60 which are permanently affixed to the door jamb 61 and to the floor.

The specific dimensions to be employed for the door jamb leveling device 40 will depend upon the size of the door jamb 61 to be installed. In general, the length of the planar spacer member 42 should be sufficient to extend from one side wall portion of the door jamb 61 to the other, and with the lip extensions 58 on either end of the member 42 extending under center portions 59 of the jamb to engage the inner surfaces 68 of the base portion 62 of anchor plates 60 along the entire length of surfaces 68. Thus the overall length of the spacer member 42, including lip extensions 58, may be of a size such as 2′ 4″, 2′ 8″, 3′ or 4′, for example, all of which are standard door jamb sizes. In one embodiment of the invention, in which the overall length of spacer member 42 is 3 feet, the width of member 42 is 4 inches, the vertical dimension of the lip extension 58 is $\frac{5}{8}$ inch and the length of extension 58 is $\frac{5}{8}$ inch. In this embodiment, the base portion 62 of jamb anchor plate 60 has an overall length of $3\frac{3}{8}$ inches and inner portion 66 thereof has a length of $\frac{5}{8}$ inches. The height of anchor plate 60 is 2 inches and the lower edge of portion 66 is located about $\frac{1}{2}$ inches above the base 62. The anchor plates 60 may be constructed of prefabricated steel or similar material. The spacer plate members 42 and 44 may be constructed of a suitable metal or other durable material.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. An adjustable jamb anchor for use in the installation of a door jamb, comprising:

at least one frame member formed in an L-shaped configuration with horizontal and vertical planar portions, said horizontal portion of the frame member having a lip formed in the other edge thereof so as to provide a slot; and a pair of L-shaped overlapping members supported by said frame member, each overlapping member having horizontal and vertical planar portions, said overlapping members having the horizontal portions thereof retained in overlapping relation within said slot and between the vertical portion of said frame member and said slot.

2. The jamb anchor of claim 1 including a pair of said frame members.

3. The jamb anchor of claim 1 wherein said lip provides a slot having a U-shaped cross section along the entire length of said frame member.

4. The jamb anchor of claim 1 wherein said frame member and said overlapping members are formed of planar sheet material having substantially the same thickness throughout.

5. The jamb anchor of claim 1 wherein the vertical portions of said frame memer and said overlapping members are of substantially the same height.

6. A method of anchoring a door jamb having a top wall member joined by at least one side wall member, which comprises:

(a) positioning an adjustable jamb anchor on the surface of a floor, said jamb anchor having at least one frame member formed in an L-shaped configuration with horizontal and vertical planar portions, said horizontal portion having a lip formed in the outer edge thereof so as to provide a slot, and said jamb anchor further including a pair of L-shaped overlapping members supported by said frame member, each overlapping member having horizontal and vertical planar portions, said overlapping members having the horizontal portions thereof retained in overlapping relation within said slot and between the vertical portion of said frame member and said slot;

(b) mounting the door jamb so that the side wall member thereof extends adjacent to the corresponding vertical members of said jamb anchor;

(c) adjusting the dimensions of said jamb anchor by sliding said overlapping members relative to each other until the vertical members of said anchor are contiguous with the side wall member;

(d) securing the jamb anchor to the floor; and (e) securing the side wall member to the jamb anchor.

7. The method of claim 6 wherein said lip of the frame member provides a slot having a U-shaped cross section along the entire length of said frame member and wherein the dimensions of the jamb anchor are adjusted by sliding the overlapping members within said slot.

8. The method of claim 6 wherein said jamb anchor includes a pair of frame members which support the overlapping members and wherein the dimensions of the jamb anchor are adjusted by sliding the overlapping members within the slots in both of said frame members.

9. The method of claim 6 including the further step of securing the overlapping members in a fixed position relative to each other.

10. The method of claim 6 including the further step of securing the overlapping members in a fixed position relative to the frame member.

11. The method of claim 6 wherein said door jamb is anchored in a level condition by mounting the door jamb initially so that the side wall member thereof rests on a portion of a leveler device, said leveler device including a planar horizontal spacer member having a threaded aperture at each end and a lip portion of relatively thin vertical dimension located at each outer end of said spacer member, a bolt member threadedly received in each aperture, each bolt having knob means at the upper end for use in rotating said bolt, and means attached to said spacer member for indicating the level condition of said spacer member, and wherein said side wall member rests on a lip portion of the leveler device, at least one of said bolts being rotated until the level indicating means shows the door jamb to be in a level condition.

* * * * *

UNITED STATES PATENT AND TRADEMARK OFFICE

CERTIFICATE OF CORRECTION

PATENT NO. : 4,539,784

DATED : September 10, 1985

INVENTOR(S) : Ernest R. Allen

It is certified that error appears in the above-identified patent and that said Letters Patent is hereby corrected as shown below:

Column 2, line 42, cancel "11" insert --12--

Column 3, line 7, cancel "member" insert --members--

Column 4, line 10, cancel "follow" insert --hollow--

Column 5, line 5 cancel "5/8" insert --1/8--

Signed and Sealed this

*Twenty-ninth* Day of *July 1986*

[SEAL]

*Attest:*

*Attesting Officer*

DONALD J. QUIGG

*Commissioner of Patents and Trademarks*